US005299852A

United States Patent [19]

Beasley

[11] Patent Number: 5,299,852

[45] **Date of Patent: * Apr. 5, 1994**

[54] STORABLE SEATING UNIT

[75] Inventor: Kim A. Beasley, Alexandria, Va.

[73] Assignee: Paralyzed Veterans of America, Washington, D.C.

[ * ] Notice: The portion of the term of this patent subsequent to Jan. 28, 2009 has been disclaimed.

[21] Appl. No.: 45,230

[22] Filed: Apr. 9, 1993

Related U.S. Application Data

[63] Continuation of Ser. No. 815,520, Jan. 2, 1992, Pat. No. 5,201,567, which is a continuation of Ser. No. 579,548, Sep. 10, 1990, Pat. No. 5,083,836.

[51] Int. Cl.[5] ..... A47C 1/121

[52] U.S. Cl. ..... 297/335; 297/13; 297/232; 297/344.21

[58] Field of Search ..... 297/13, 142, 162, 232, 297/240, 331, 335, 349; 248/145

[56] References Cited

U.S. PATENT DOCUMENTS

| | | | |
|---|---|---|---|
| 941,983 | 11/1909 | Elsner | 297/335 X |
| 1,007,041 | 10/1911 | Miller | 297/335 X |
| 1,015,799 | 1/1912 | Haren | 297/375 X |
| 1,318,439 | 10/1919 | Erickson | 297/13 |
| 2,604,925 | 7/1952 | Swift | 297/349 X |
| 3,191,400 | 6/1965 | Swenson | 297/349 |
| 3,275,283 | 9/1966 | Rauch | 297/349 X |
| 3,708,203 | 1/1973 | Barecki | 297/349 X |

*Primary Examiner*—Peter R. Brown

*Attorney, Agent, or Firm*—Oblon, Spivak, McClelland, Maier & Neustadt

[57] ABSTRACT

A storable seating unit for access by an individual in a wheelchair to seating in a stadium or arena which includes a pedestal, a seat bottom pivotally connected to the pedestal, a seat back pivotally mounted to one of the seat back and the pedestal, the pedestal including a mechanism for pivoting the seat bottom and seat back so as to define an open area for positioning of the wheelchair in a position occupied by the seat bottom and seat back prior to pivoting. The pedestal may include a longitudinal slot and a slide pivotally and slidably positioned therein and connected to said seat bottom and seat back for pivoting of the seat bottom and seat back and lowering thereof along the length of the slide.

2 Claims, 3 Drawing Sheets

STORABLE SEATING UNIT

This is a continuation of application Ser. No. 07/815,520, filed on Jan. 2, 1992, now U.S. Pat. No. 5,201,567, Ser. No. 07/579,548 filed Sep. 10, 1990 now U.S. Pat. No. 5,083,836.

BACKGROUND OF THE INVENTION

1. Field of the Invention

The present invention is directed to a storable seating unit for access by a wheelchair such as, for example, stadium seats or arena seats.

2. Discussion of the Background

It is well understood that seating for handicapped individuals in wheelchairs is difficult to provide in stadiums and arenas due to the rigid structure of the fixed seating, leaving little or no flexibility of seating to accommodate individuals who may be handicapped and require a wheelchair. Thus there has been a strong desire for providing storable stadium seating which has the flexibility of accommodating individuals of all types while providing a uniform design and being aesthetically pleasing. Heretofore it has been necessary to designate special areas to accommodate only individuals in wheelchairs, which areas are basically in the form of open areas near guardrails, these areas being dispersed throughout designated areas of stadiums and arenas and thus not allowing handicapped individuals to be seated with individuals who are not handicapped. Thus, handicapped individuals have not been able to easily socialize with non-handicapped individuals during events occurring at stadiums and arenas. There has therefore been recognized a need for providing seating which allows handicapped individuals to mix socially with others and to do so in an easy and convenient manner without drawing attention to their disabilities and without obstructing entrances and exits.

SUMMARY OF THE INVENTION

Accordingly, the present invention serves to answer the problems which have previously existed in stadiums, arenas and auditoriums while answering the need for an aesthetically pleasing appearance of all seating within the stadium. The seating design in accordance with the present invention is intended to replicate the more conventional seating found in stadiums and similar facilities. This design, however, allows for a unique folding and storage to permit a wheelchair user to have access to general seating areas.

The seating unit is mounted, in accordance with one embodiment, on a double pedestal for independent operation of each seat. The seats may fold up in a conventional manner, then pivot about the axis of the pedestal upon which it is mounted until it drops into the pedestal sleeve or slides along the axis thereof by provision of a slot in the sleeve. It is intended to provide for easy operation, a minimal number of parts, low maintenance and safe use by patrons utilizing the facility.

The folding action of the seating unit in accordance with the present invention can also be designed to fold in another manner, i.e., the seat back may be folded down to the seat bottom, the flip up by the pivot connection of the seat bottom to the pedestal and slide down the pedestal to achieve a similar storage capability.

DETAILED DESCRIPTION OF THE PREFERRED EMBODIMENTS

Figure 1:
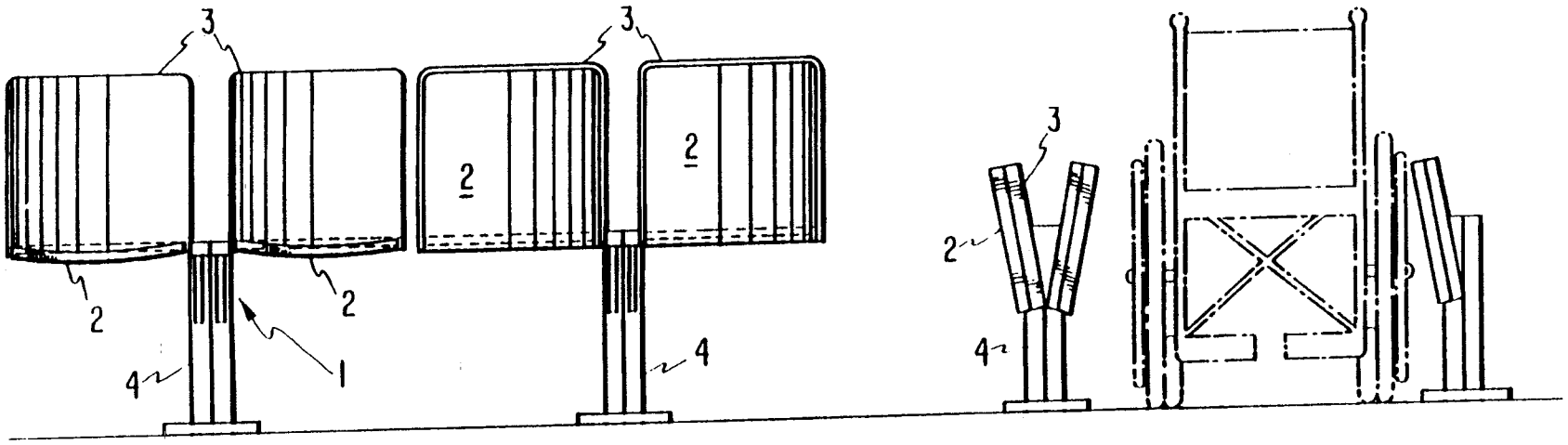
FIG. 1 is an elevational view of a row of seating units with one unit being folded up to accommodate an individual in a wheelchair in accordance with the present invention.
Figure 2:
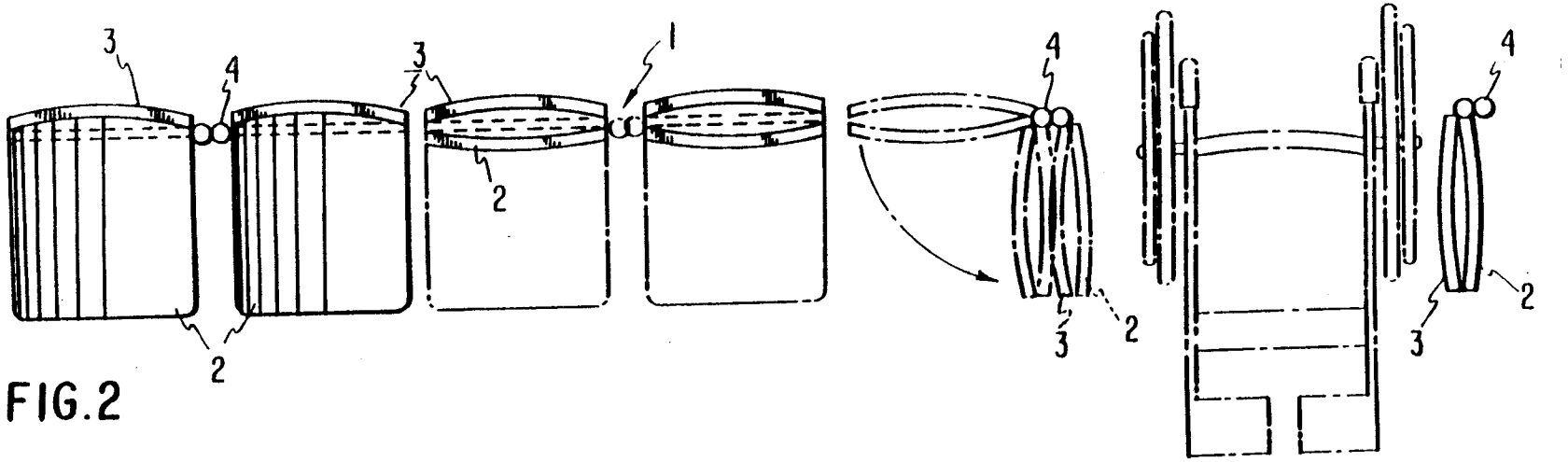
FIG. 2 is a top view of FIG. 1 illustrating the manner in which the seating unit seat and back are pivotally mounted to the pedestal for providing access to an opening by an individual in a wheelchair.
Figure 3:
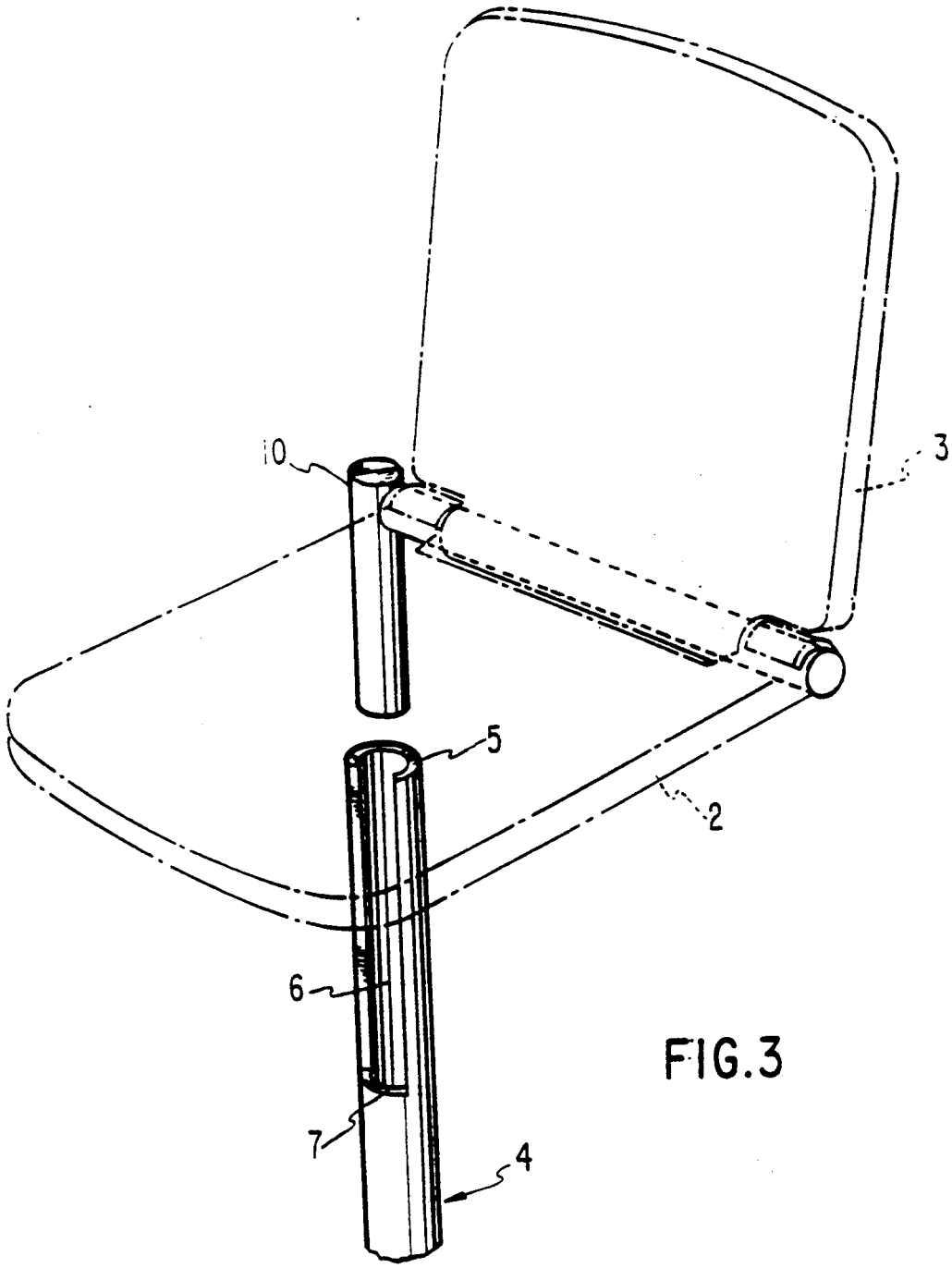
FIG. 3 shows details of the pedestal and associated seating unit in accordance with the present invention.

With reference to the Figures demonstrating preferred embodiments of the present invention, it is to be noted that a seating unit 1 includes a seat bottom 2 and seat back 3 with the seat being pivotally mounted to the seat back to tilt upward in a manner normally found in stadium seating. However, in order to provide further access of the space above the stadium floor occupied by the seat, when necessary, for accommodating an individual in a wheelchair, it is possible, in accordance with the present invention, to further pivot the seat bottom 2 and seat back 3 as a unit about a vertical pivot member accommodated within a pedestal member 4. The pedestal member 4 is characterized by a longitudinal slot within which the combined seat and seat back is slidable via an L-shaped slide upon being pivoted forwardly as illustrated in FIG. 2 so as to disengage from a ledge 5 of the pedestal and then register with a slot 6. The combined seat and seat back is then allowed to be guided downwardly along the slot 6 in the pedestal 4 until reaching a stop member 7 which defines a lower, stored position of the folded seat. As illustrated in FIG. 1, the thus folded seat forms a compact unit that serves to provide adequate space for an individual in a wheelchair who can thus attend stadium and area events with other individuals who are seated in regular seating adjacent him or her.

Figure 4:
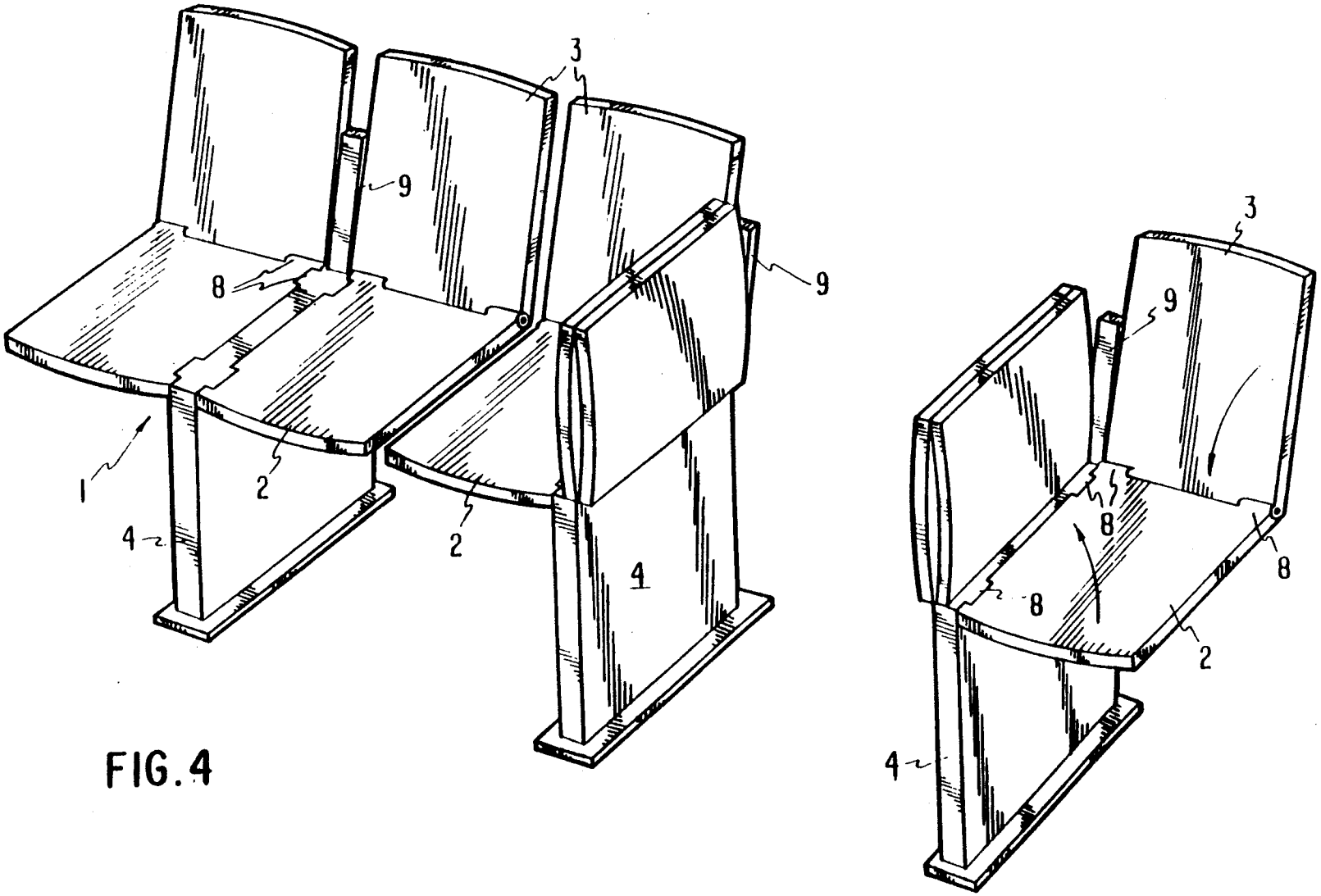
FIG. 4 illustrates a second embodiment of the present invention.

As must be understood, variations on this embodiment are possible such as that illustrated in FIG. 4, which demonstrates that it is possible to pivotally connect the back of the seat to the seat by pivot members 8, 8. Upon folding down of the seat back 3 seat onto the seat 2, the entire seat can be pivoted about pivot members 8, 8 by means of its connection with the pedestal 4 in an upward direction so as to be vertically oriented as illustrated in FIG. 4. This orientation also serves to accommodate an individual in a wheelchair on either side of the pedestal 4, if necessary. Of course, it is also possible to modify this structure to have the seat back 3 pivot down on top of the seat 2, and this combination to pivot up to be aligned with pedestal 4. Pivotable arms 9 could also be used which would be pivotably connected either to the pedestal 4 or seat back 3 so as to be storable if needed.

Obviously, numerous modifications and variations of the present invention are possible in light of the above teachings. It is therefore to be understood that within the scope of the appended claims, the invention may be practiced otherwise than as specifically described herein.

What is claimed as new and designed to be secured by Letters Patent of the United States is:

1. A storable seating unit comprising:

(a) an at least approximately vertical cylindrical pedestal member having a central axis;

(b) a cylindrical slide that slides telescopically with respect to said least approximately vertical cylindrical pedestal member and that is capable of pivoting about said central axis of said at least approximately vertical cylindrical pedestal member back and forth between a first position and a second position;

(c) a seat mounted on said cylindrical slide, said seat comprising a seat back and a seat bottom that are pivotable relative to one another;

(d) one of said at least approximately vertical cylindrical pedestal member and said cylindrical slide having a first upwardly facing abutment surface and a second upwardly facing abutment surface angularly spaced about said central axis from said first upwardly facing abutment surface; and (e) the other of said at least approximately vertical cylindrical pedestal member and said cylindrical slide having a downwardly facing abutment surface that can be brought into engagement with either said first upwardly facing abutment surface or said second upwardly facing abutment surface, depending on the angular position of said cylindrical slide relative to said at least approximately vertical cylindrical pedestal member, said downwardly facing abutment surface not being in contact with said second upwardly facing abutment surface when it is in contact with said first upwardly facing abutment surface and vice versa, whereby said storable seating unit can be manipulated back and forth between:

(f) a first position in which:

(i) said the other of said at least approximately vertical cylindrical pedestal member and said cylindrical slide is supported solely by said first upwardly facing abutment surface and (ii) said seat bottom and said seat back are pivoted away from each other, allowing a person to sit in said storable seating unit, and (g) a second position in which:

(i) said the other of said at least approximately vertical cylindrical pedestal member and said cylindrical slide is supported solely by said second upwardly facing abutment surface and (ii) said seat bottom and said seat back are juxtaposed against each other.

2. A storage seating unit comprising:

(a) a pedestal member having a central axis;

(b) a slide that slides telescopically with respect to said pedestal member and that is capable of pivoting about said central axis of said pedestal member back and forth between a first position and a second position;

(c) a seat mounted on said slide, said seat comprising a seat back and a seat bottom that are pivotable relative to one another;

(d) one of said pedestal member and said slide having a first upwardly facing abutment surface and a second upwardly facing abutment surface angularly spaced about said central axis from said first upwardly facing abutment surface; and (e) the other of said pedestal member and said slide having a downwardly facing abutment surface that can be brought into engagement with either said first upwardly facing abutment surface or said second upwardly facing abutment surface, depending on the angular position of said slide relative to said pedestal member, said downwardly facing abutment surface not being in contact with said second upwardly facing abutment surface when it is in contact with said first upwardly facing abutment surface and vice versa, whereby said storable seating unit can be manipulated back and forth between:

(f) a first position in which:

(i) said the other of said pedestal member and said slide is supported by said first upwardly facing abutment surface and (ii) said seat bottom and said seat back are pivoted away from each other, allowing a person to sit in said storable seating unit, and (g) a second position in which:

(i) said the other of said pedestal member and said slide is supported by said second upwardly facing abutment surface and (ii) said seat bottom and said seat back are juxtaposed against each other.

* * * * *